US007131633B2

(12) United States Patent
Delaney

(10) Patent No.: US 7,131,633 B2
(45) Date of Patent: Nov. 7, 2006

(54) MANUALLY CONTROLLED REPLACEMENT SOLENOID FOR HYDRAULIC VALVES

(75) Inventor: Patrick M. Delaney, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 17 days.

(21) Appl. No.: 10/918,782

(22) Filed: Aug. 13, 2004

(65) Prior Publication Data

US 2006/0033599 A1 Feb. 16, 2006

(51) Int. Cl.
*H01F 7/08* (2006.01)

(52) U.S. Cl. ..... 251/129.15; 123/90.11; 123/90.12; 303/119.2

(58) Field of Classification Search ..... 251/129.15
See application file for complete search history.

(56) References Cited

U.S. PATENT DOCUMENTS

| | | | | |
|---|---|---|---|---|
| 3,212,751 | A * | 10/1965 | Hassa | 251/65 |
| 4,605,197 | A * | 8/1986 | Casey et al. | 251/30.01 |
| 5,482,362 | A | 1/1996 | Robinson | |
| 5,697,397 | A * | 12/1997 | Mellem et al. | 137/315.35 |
| 6,352,317 | B1 | 3/2002 | Blazic et al. | |
| 2002/0038857 | A1 * | 4/2002 | Strobel | 251/129.15 |

* cited by examiner

*Primary Examiner*—J. Casimer Jacyna
(74) *Attorney, Agent, or Firm*—Jeffrey P. Caffe; Dennis K. Sullivan; Susan L. Lukasik

(57) ABSTRACT

Solenoid controlled hydraulic valves in sealed hydraulic circuits are provided with backup actuation without compromise of the hydraulic circuit by provision of an auxiliary, quick fitting solenoid coil case which incorporates manual switches and which may be attached directly to a battery for energization.

1 Claim, 4 Drawing Sheets

MANUALLY CONTROLLED REPLACEMENT SOLENOID FOR HYDRAULIC VALVES

BACKGROUND OF THE INVENTION

1. Technical Field

The invention relates in general to solenoid control elements for hydraulic valves and more particularly to a quick fitting replacement solenoid for use as a diagnostic tool or backup actuator for a spool type hydraulic valve in a closed hydraulic circuit.

2. Description of the Problem

Vehicle mounted hydraulic systems have been employed for diverse purposes including positioning snowplows, compacting trash, moving support beds and other functions. Such hydraulic systems are controlled using spool valves and these spool valves in turn have often been manually activated, with handles mechanically linked to the spool valves. The mechanical link must of course be sealed to avoid spillage of pressurized hydraulic fluid. However, these seals are prone to wear and leaks almost invariably develop.

To avoid, or at least postpone, the development of leaks, solenoid controlled hydraulic valves have been developed. A solenoid coil is used to generate magnetic fields to control positioning of the spool valve inside the valve body without the need for a mechanical linkage through the valve body. Without a mechanical linkage, the need for mechanical seals around a linkage is eliminated. Solenoid actuated valves are much less prone to leakage than mechanically actuated valves, but they complicate making provision for fitting an override control mechanism to the valve. Some manufacturer's have retained a mechanical linkage to use as a backup to the electromagnetic system. While the linkages are now used less often, they still represent a compromise of the full sealing of the hydraulic system, and they can still develop leaks over time due to thermal cycling or chemical attack. The use of solenoids also eases integration between a vehicle's hydraulic systems and the vehicle's electronic control systems. This in turn raises questions in some minds as to the reliability of the electronic controls or the ability to diagnose a problem as being electronic or hydraulic, should a problem occur.

SUMMARY OF THE INVENTION

According to the invention there is provided a solenoid coil and valve assembly having an hydraulic valve body having a rod like extension. The solenoid coil is held within a tube shaped coil case sized and shaped to fit over and around the rod like extension after removal of the original coil assembly. An electrical switch carrier is mounted to an outside surface of the tube shaped coil case. Electrical leads from the switch body provide for direct, temporary connection to a battery.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
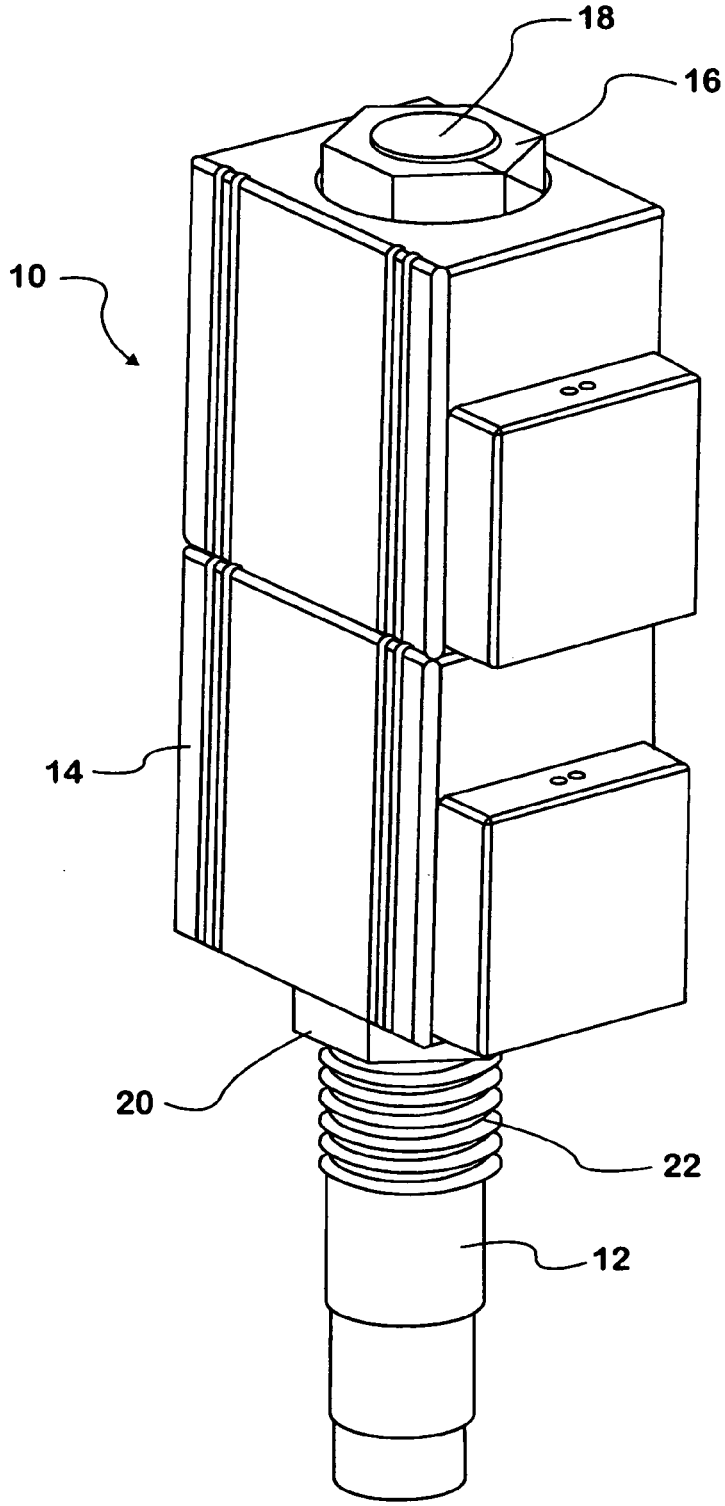
FIG. 1 (PRIOR ART)
FIG. 1 is a perspective view of a prior art solenoid controlled hydraulic valve assembly.

Referring now to the figures and in particular to FIG. 1, a prior art solenoid controlled hydraulic valve assembly 10 is shown comprising a hydraulic valve, the stem 12 of which is visible extending below a coil package 14.

Coil package 14 is substantially self contained, providing only inputs for connection to an electronic control system. Coil package 14 provides bidirectional control of the valve. Coil package 14 fits over the upper end of valve body 18 and is retained on valve body 18 using a nut 16 threaded onto a threaded upper end of valve body 18. A nut 20 threaded onto the lower a middle threaded section 22 of valve body 18 positions double ended coil package 14.

Figure 2A:
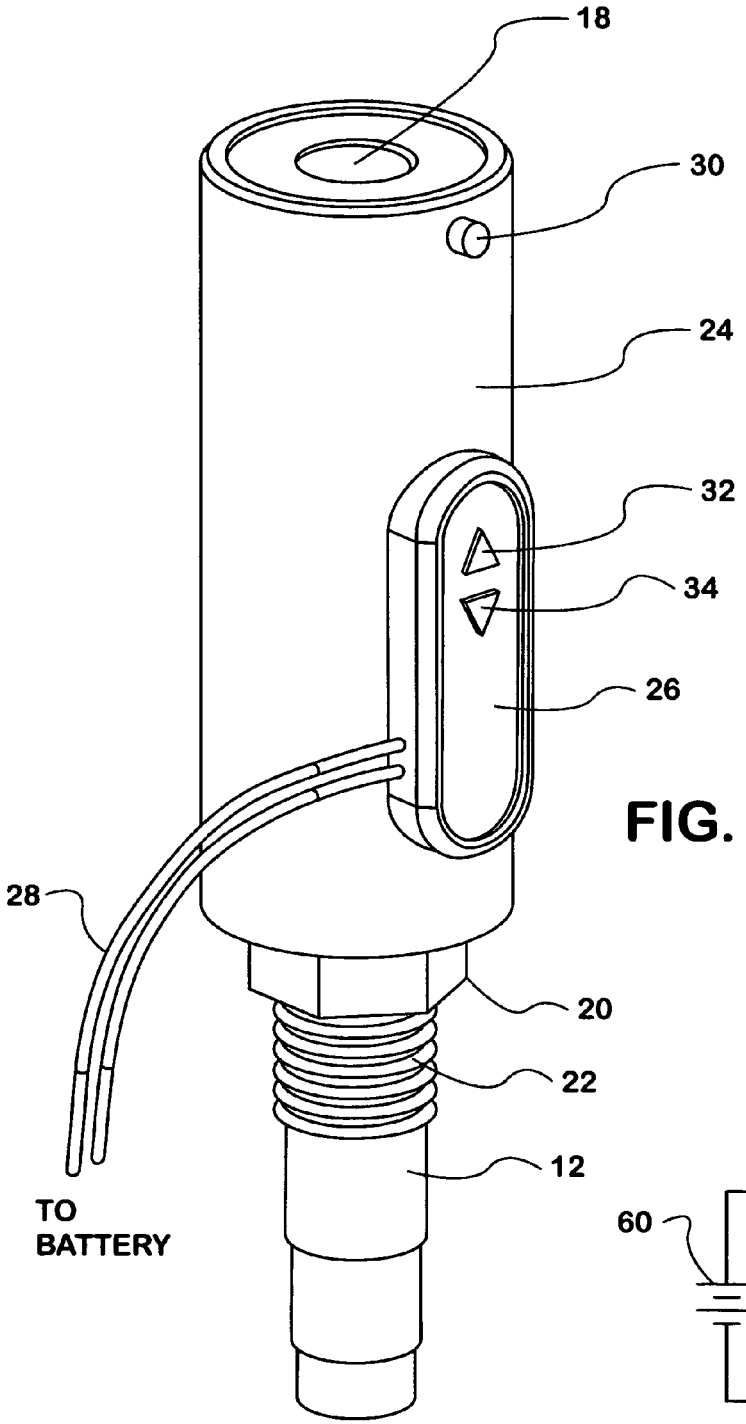
FIG. 2A is a perspective view of an solenoid controlled hydraulic valve assembly according to the present invention.
Figure 2B:
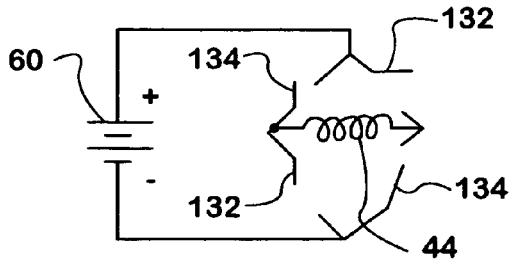
FIG. 2B is a circuit schematic for the solenoid controller.

Referring to FIG. 2A a replacement solenoid body 24 is a tube like structure, fitted over valve body 18 to provide manual control over the valve. Switches 32, 34 are disposed on a switch box 26 which in turn is carried on the outside surface of the replacement solenoid body 24. Switches 32, 34 provide for manual energization of the solenoid coil 44. Switch box 26 has electrical leads 28 which are intended for direct connection to a 12 volt battery, such as the motor vehicle battery or an auxiliary battery. A quick release button 30 extends from the replacement solenoid body 24 near the upper rim of the solenoid body. The circuit for the solenoid 44 of FIG. 2B may be represented as a bridge circuit connected across a battery 60. External buttons 32 and 34 correspond to switch sets 132 and 134, respectively, which are arranged to energize coil 44 in either of two directions.

Figure 3:
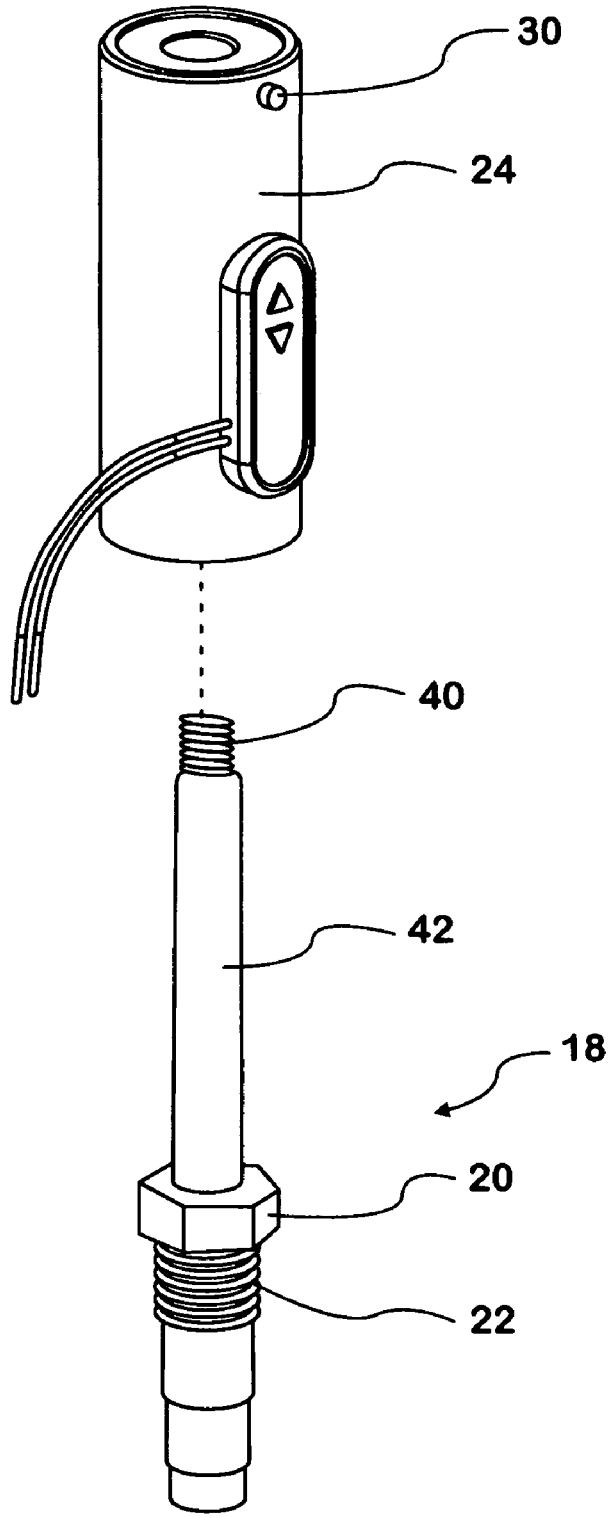
FIG. 3 is an exploded view of a solenoid controller and a hydraulic valve.
Figure 4:
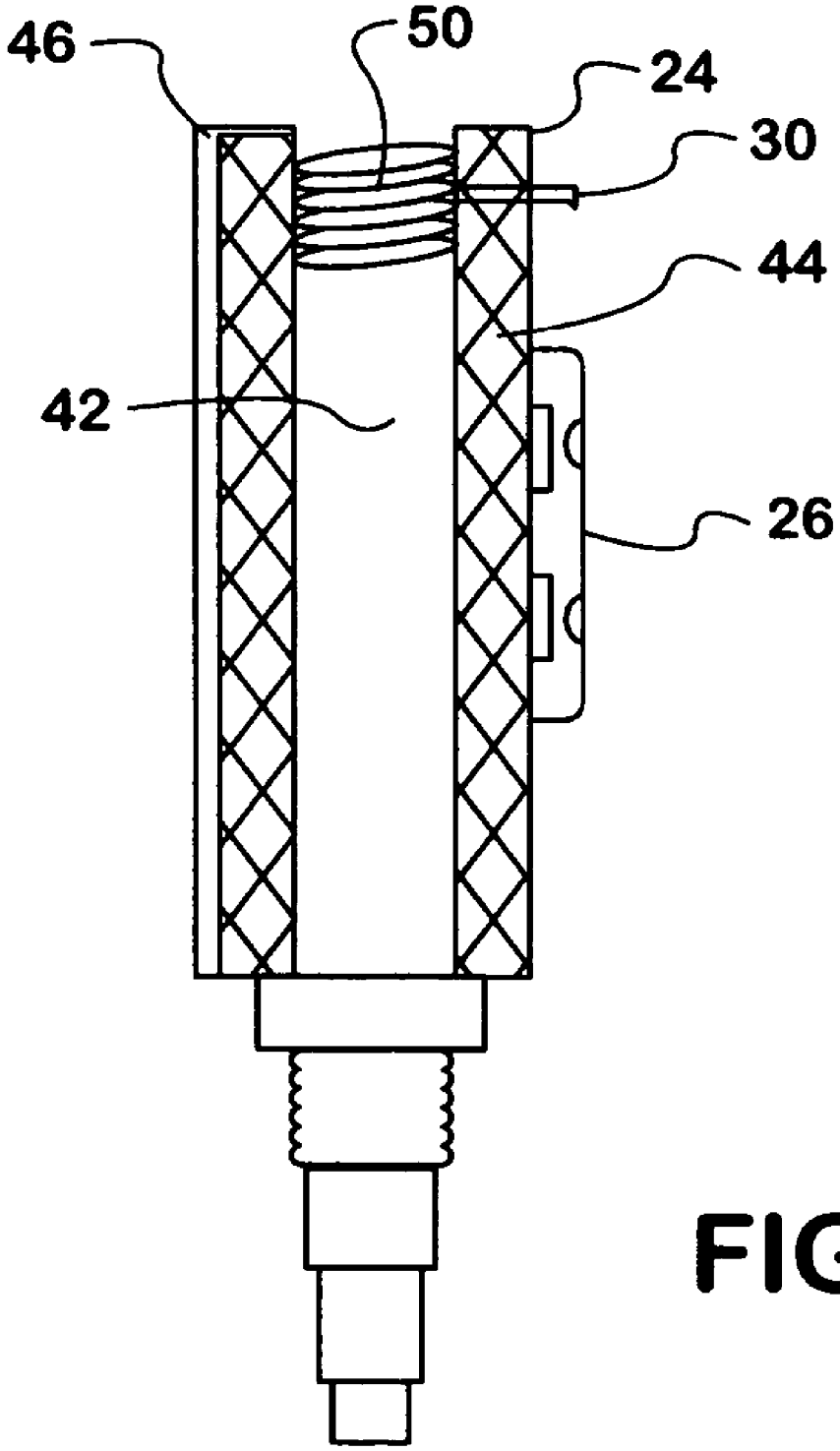
FIG. 4 is a partial cross sectional view of the solenoid controlled hydraulic valve assembly of FIG. 2.

As seen in FIG. 3, replacement solenoid body 24 fits around an upper rod like segment 42 of valve body 18 and may be fitted with a quick release mechanism released by button 30 which cooperates with threads 40 for retaining body 24 on rod 42. The partial cross section of FIG. 4 better illustrates that replacement valve body 24 is a tube, constructed from a casing 46 which contain coils 44 in its interior. Coils 44 are energized by use of switch box 26. Switch box 26 contains two momentary switches used for bidirectional control of the spool valve (not shown) disposed inside valve body 26. The quick release mechanism 30 extends through casing 46 and cooperates with threading 50 at the top end of rod 42.

The invention gives operators the confidence that they can move to electronics controlled hydraulic systems, with a fully sealed hydraulic system, without losing the ability to manually control valves using a direct, simple, electrical system. Mechanical backups to electronic solenoid valve control is eliminated.

While the invention is shown in only one of its forms, it is not thus limited but is susceptible to various changes and modifications without departing from the spirit and scope of the invention.

What is claimed is:

1. Apparatus comprising:

a tube shaped coil case sized and shaped to fit on to a hydraulic valve body having a positionally fixed, rod like extension;

a switch carrier mounted onto an outside surface of the tube shaped coil case;

a quick release mechanism mounted through the tube like coil case for locking the tube like coil case on the rod like extension for retaining the tube like coil case on the hydraulic valve body; and electrical leads for connection to a battery extending from the switch carrier.

* * * * *